US009288856B2

(12) United States Patent
Marchesin et al.

(10) Patent No.: US 9,288,856 B2
(45) Date of Patent: Mar. 15, 2016

(54) DRIVER CIRCUIT OF LIGHT SOURCES AND VEHICLE LIGHT PROVIDED WITH SAID DRIVER CIRCUIT OF LIGHT SOURCES

(71) Applicant: AUTOMOTIVE LIGHTING ITALIA S.p.A. A SOCIO UNICO, Venaria, Turin (IT)

(72) Inventors: Stefano Marchesin, Turin (IT); Andrea Englaro, Turin (IT); Matteo Iellina, Turin (IT)

(73) Assignee: AUTOMOTIVE LIGHTING ITALIA S.P.A., Turin (IT)

( * ) Notice: Subject to any disclaimer, the term of this patent is extended or adjusted under 35 U.S.C. 154(b) by 273 days.

(21) Appl. No.: 14/134,062

(22) Filed: Dec. 19, 2013

(65) Prior Publication Data

US 2014/0184079 A1 Jul. 3, 2014

(30) Foreign Application Priority Data

Dec. 27, 2012 (IT) ..... PD2012A0410

(51) Int. Cl.
*H05B 33/08* (2006.01)

(52) U.S. Cl.
CPC ..... *H05B 33/0815* (2013.01); *H05B 33/0824* (2013.01)

(58) Field of Classification Search
CPC ..... H05B 33/0815; H05B 33/0823
See application file for complete search history.

(56) References Cited

U.S. PATENT DOCUMENTS 7,936,135 B2 * 5/2011 Hum ..... H05B 33/083 315/169.3

FOREIGN PATENT DOCUMENTS

EP 2288234 A1 2/2011
WO 2012156878 A1 11/2012

* cited by examiner

*Primary Examiner* — Hai L Nguyen
(74) *Attorney, Agent, or Firm* — Howard & Howard Attorneys PLLC

(57) ABSTRACT

Driver circuit of light sources, particularly of the LED type, comprising a first and at least a second group of light sources, each connected to a common power supply terminal, a first and at least a second regulation circuit, each suitable for regulating the current absorbed by a respective group of light sources, at least one actuation circuit operatively connected to a respective second regulation circuit, and a serial connection circuit, suitable for connecting in series at least a first and a second group of light sources, when the voltage downstream of the first group of light sources is greater than or equal to the voltage upstream of the second group of light sources.

16 Claims, 8 Drawing Sheets

DRIVER CIRCUIT OF LIGHT SOURCES AND VEHICLE LIGHT PROVIDED WITH SAID DRIVER CIRCUIT OF LIGHT SOURCES

CROSS-REFERENCE TO RELATED APPLICATION

This application is based upon and claims priority to Italian Patent Application PD2012A000410 filed on Dec. 27, 2012.

BACKGROUND OF INVENTION

1. Field of Invention

The invention relates to a driver circuit of light sources, particularly of the LED type, and to a front or rear vehicle light, provided with such a driver circuit of light sources to make one or more lamps of the vehicle light itself, such as a stop lamp, a front or rear parking lamp, a front or rear turn signal lamp, a reversing lamp, a rear fog lamp, a front or rear side parking lamp, a low beam lamp, a high beam lamp, a daylight running lamp (DRL), a fog lamp, a cornering lamp, and the like.

2. Description of the Related Art

A driver circuit of light sources is known in the art, including a plurality of light sources, particularly of the LED type, structured so as to emit light when subjected to a power supply voltage, wherein the driver circuit of the light sources is configured to position the plurality of light sources in at least a first and a second matrix arrangement of n rows×m columns, upon the variation of the power supply voltage.

The plurality of light sources of the driver circuit is further able to absorb an overall electric current defined by a constant electric current value In for each of said first and second matrix arrangement of the light sources, multiplied by a number of m columns of the matrix arrangement of the light sources. The number of columns ml of the matrix of the first matrix arrangement of the light sources is greater than the number of columns m2 of the matrix of the second matrix arrangement of the light sources. Consequently, the number of light sources of each column of the first matrix arrangement of the light sources is smaller than that of each column of the second matrix arrangement of the light sources. Thus, the first matrix arrangement of the light sources requires a power supply voltage lower than that of the second matrix arrangement of the light sources to turn on the plurality of light sources. Consequently, the plurality of light sources arranged according to the first matrix arrangement can emit light at a lower power supply voltage than the second matrix arrangement of light sources, without encountering a flickering of light itself, to the detriment, however, of a greater electric power consumption than the second matrix arrangement of the light sources. In fact, the electric power consumption of the light sources arranged in a matrix depends on the number of columns m of the LED matrix.

Specifically, the electric power consumption is given by the formula:

$P(V)=m\times In\times V$, wherein P(V) is the electric power absorbed by the plurality of light sources, m is the number of columns, In is the constant electric current, and V is the variable power supply voltage.

For the above reason, the transition between the first and the second matrix arrangement of the light sources (namely the transition from the matrix arrangement of the light sources with more columns between the two) to that with fewer columns between the two, needs to occur at a value of power supply voltage as small as possible.

With reference to FIG. 1, by way of example, the electric power P(V) dissipated by the light sources arranged with a first matrix arrangement of two rows and six columns and a second matrix arrangement of three rows and four columns A polyline is obtained by plotting the electric power P(V), given by a first slope segment 6In, a step in vertical descent, at the power supply voltage in which the driver circuit of the light sources switches from the first to the second arrangement of the light sources, and a second slope segment 4In.

However, the above-mentioned driver circuit of light sources, to which reference will be made in the continuation of the description with the expression "dynamic matrix", has some drawbacks. In fact, the number of light sources needs to be dividable by the number of rows, or columns, of the first and second matrix arrangement of the light sources, respectively. For example, eighteen light sources can be arranged in a matrix in a first matrix arrangement of light sources of six rows by three columns, and in a second matrix arrangement of light sources of three rows by six columns, since the eighteen light sources are dividable by the number of rows, or columns, of both the first and the second matrix arrangement of the light sources. However, the eighteen light sources cannot be arranged in a matrix arrangement of light sources having, for example, five rows, since the eighteen light sources are not dividable by the number of rows in the matrix arrangement of the light sources.

A further drawback of the dynamic matrix occurs when one or more light sources in the matrix must be under-powered to emit a weaker light compared to the remaining light sources in the matrix. This need can occur, for example, in the field of automotive lights, where an illuminating surface of the vehicle light may include an illuminating area with low light intensity and an illuminating area with high light intensity, for photometric requirements. One might think of connecting electric resistors to the light sources affecting the illuminating area with low light intensity, so that such light sources absorb less electric current than the other light sources affecting the illuminating area with high light intensity (for example, in the first matrix arrangement of the light sources). However, the electric resistors may be connected differently to the light sources, when the driver circuit of the light sources has switched to the second matrix arrangement of the light sources, thus not guaranteeing the desired effect anymore.

Yet another drawback derives from the fact that the instant at which the transition from the first to the second arrangement of the light sources occurs (namely the transition from the matrix arrangement of the light sources with more columns to that with less columns) at a power supply voltage determined in the design phase. Such a power supply voltage is overestimated in the design phase in order to ensure the switch on of the LEDs to the detriment, however, of electric power consumption.

SUMMARY OF INVENTION

The task of the invention is to overcome the above drawbacks with reference to the dynamic matrix. In this context, the main object of the invention is to vary the topology of the arrangement of the light sources, particularly LEDs, so as to minimize the power absorbed by the driver circuit of the light sources to drive the light sources upon the variation of the power supply voltage of the light sources, without the constraints of the arrangement of the light sources. In particular, the arrangement of the light sources may include branches of light sources.

A further object of the invention is to vary the topology of the arrangement of the light sources, so as to minimize the power absorbed by the driver circuit of the light sources to drive the light sources upon the variation of the power supply voltage of the light sources, when the light sources affect an illuminating area with low light intensity and an illuminating area with high light intensity.

In the specific case of LED light sources, a further object of the invention is to automatically switch from a first to a second arrangement of the LEDs, having fewer columns, or branches, than the first arrangement of the LEDs. In other words, it is not necessary to identify (in the design phase) a power supply voltage value of the LEDs, wherein the driver circuit of the LEDs switches from the first to the second arrangement of the LEDs.

In order to achieve these objects, the driver circuit of light sources of the invention includes a plurality of light sources, particularly of the LED type, divided into a first and at least a second group of light sources, each connected to a common power supply terminal, a first and at least a second regulation circuit, each suitable for regulating the current absorbed by a respective group of light sources, at least one actuation circuit operatively connected to a respective second regulation circuit, and serial connection circuit, suitable for connecting in series at least a first and a second group of light sources, when the voltage downstream of the first group of light sources is greater than or equal to the voltage upstream of the second group of light sources.

In a first state of the driver circuit of light sources, the voltage downstream of the first group of light sources referred to ground is lower than the voltage upstream of the second group of light sources referred to ground, and the first and the second group of light sources are driven independently. More precisely, the first regulation circuit drives the first group of light sources, while the actuation circuit of the regulation circuit inhibits the functioning of the second regulation circuit and drives the second group of light sources, on the basis of a reference electric magnitude of the second regulation circuit.

In a second state of the driver circuit of light sources, the voltage downstream of the first group of light sources referred to ground is greater than or equal to the voltage upstream of the second group of light sources referred to ground, and the first and the second group of light sources are driven together, after having been connected in series to each other. More precisely, the first regulation circuit and the actuation circuit of the regulation circuit are inhibited, while the second regulation circuit drives the first and the second group of light sources.

BRIEF DESCRIPTION OF THE DRAWINGS

Further features and advantages of the driver circuit according to the present invention will appear more clearly from the following description of embodiments thereof, made with reference to the annexed drawings, wherein.

DETAILED DESCRIPTION OF THE EMBODIMENTS OF THE INVENTION

Figure 1:
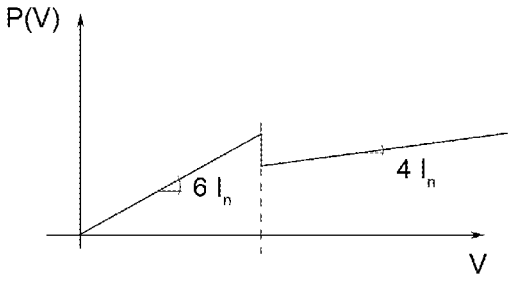
FIG. 1 is a graph of the electric power absorbed by the dynamic matrix driver circuit.

In the following description, the term "connected" refers to both a direct electric connection between two circuits or circuit elements and to an indirect connection through one or more active or passive intermediate elements. The term "circuit" may denote either a single component or a plurality of components, active and/or passive, connected together to obtain a predefined function. Also, where a bipolar junction transistor (BJT) or a field-effect transistor (FET) may be used, the meaning of the terms "base", "collector", and "emitter" includes the terms "gate", "drain", and "source", and vice versa. If not indicated otherwise, NPN transistors may be used in place of PNP transistors, and vice versa.

The driver circuit of light sources according to the invention includes a plurality of light sources, particularly LEDs 10, to which reference will be made in the description, and regulation circuits each having a reference of an electric magnitude (for example, an IREF electric current).

The plurality of LEDs is divided into groups, for example a first group 1 and a second group 2. Such groups of LEDs include, respectively, one or more LEDs 10 connected together, for example, as a matrix (matrix of n rows by m columns, in particular 1 row by m columns), or as a branch (matrix of n rows by 1 column). For the sake of simplicity, the following description will refer to a first and to a second group of LEDs, which include, respectively, two LEDs connected in series with each other.

The driver circuit of the invention is divided into modules 100, 200, 300, . . . , for example, a first 100 and a second module 200 connected together by a serial connection D. The first module 100 includes a first regulation circuit 120 and a first group of LEDs 1; the second module 200 includes a second regulation circuit 220, an actuation circuit 230 of the regulation circuit and a second group of LEDs 2. Any additional modules 300, 400, . . . , are equal to the second module 200.

Figure 2:
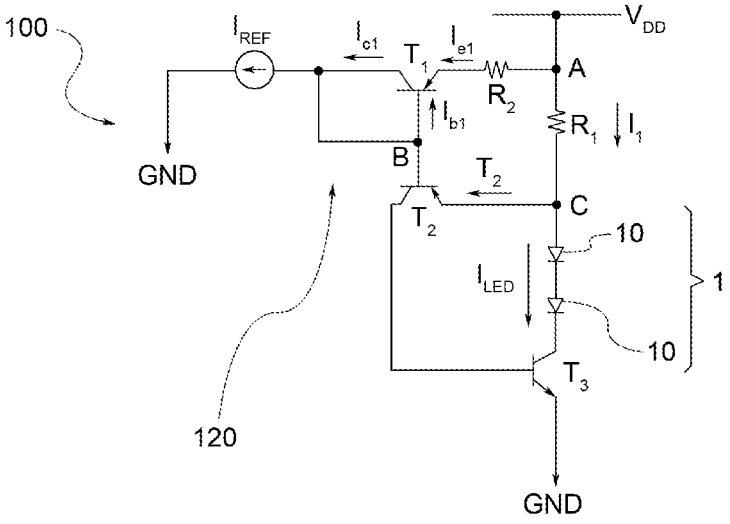
FIG. 2 is a circuit diagram of a first module of the lighting circuit according to the invention, including a group of light sources and a regulation circuit.

FIG. 2 shows the first module 100, wherein the first regulation circuit 120 serves for driving the first group of LEDs 10. The first regulation circuit 120 includes a sensing resistor R1, suitable to detect the current I1 circulating on the branch of LEDs, a current mirror including transistors T1 and T2, and a resistor R2, a generator of a reference electric magnitude, for example an IREF current, and a driver transistor T3, for driving the first group of LEDs 1. The sensing resistor R1 is connected, for example, between a power supply terminal VDD and the first group 1 of LEDs 10; and the driver transistor T3 has the collector connected to the group of LEDs and the emitter connected to ground. The first transistor T1 of the current mirror has the emitter connected, through the emitter resistor R2, to a node A between the power supply terminal VDD and the sensing resistor R1. The second transistor T2 of the current mirror has the emitter connected to a node C between the sensing resistor R1 and the first group 1 of LEDs. The collector of the second transistor T2 is connected to the base of the driver transistor T3. The bases of the two transistors T1 and T2 of the current mirror are connected together and to the collector of the first transistor T1. The generator of the reference current IREF is connected to the collector. Transistors T1, T2 of the current mirror work in a linear zone. The driver transistor T3 also works in a linear zone, except in an initial phase, in which the transistor T3 works in the saturation zone, so as to allow a switch on of the first group of LEDs at a power supply voltage given by sum of the junction voltages of the LEDs of the first group arranged in series, plus any other voltage drops present in the branch of the first group of LEDs.

Specifically, the first transistor T1 of the current mirror is polarised in the linear zone and therefore, its collector-emitter voltage Vce1 is at least equal to its base-emitter voltage Vbe1. Consequently, the base current Ib1 of the first transistor T1 is negligible with respect to its emitter current Ie1; therefore, the emitter current Ie1 of the first transistor T1 is equal to the collector current Ic1 of the transistor T1. Moreover, the collector current Ic1 of transistor T1 is equal to the IREF current imposed by the current generator. Consequently, the emitter current Ie1 of the first transistor T1 is equal to the IREF current imposed by the current generator.

For Kirchhoff's second principle applied to mesh ABC in FIG. 2:

$$Vab=R2*IREF+Vbe1$$

Vab=R1*I1+Vbe2, where I1 is the current circulating on the sensing resistor R1 and Vbe2 is the base-emitter voltage of the second transistor T2 of the current mirror. On the other hand, the base-emitter voltage Vbe1 of the first transistor T1 and the base-emitter voltage Vbe2 of the second transistor T2 are equal, i.e. Vbe1=Vbe2. This is because the collector current Ic1 of the first transistor T1 and the collector current Ic2 of the second transistor T2 are comparable, due to the construction of the current mirror including transistors T1 and T2, the emitter resistor R2 and the IREF current generator, and because transistors T1 and T2 are integrated in the same package and thus have the same electric features.

Consequently, by equating the two expressions of Vab, we obtain the expression of current I1, which is as follows: I1=(R2/R1)IREF. This also provides the current absorbed by the group of LEDs ILED, or ILED=(R2/R1)IREF. In fact, the current I2 is negligible compared to current I1, since the branch of the second transistor T2 has a much higher resistivity than that of the branch of the first group of LEDs.

Regarding the feedback made by the first regulation circuit 120, where the current absorbed by the first group of LEDs tends to increase. Such a situation occurs, for example, during the switch on of the driver circuit of LEDs, in which the branch of LEDs is connected to a very low sensing resistor R1, and to the driver transistor T3, which is located in the saturation zone. Consequently, current I1 absorbed by LEDs (I2 is negligible) tends to increase exponentially. If the current I1 absorbed by the LEDs increases, the voltage drop Vac at the terminals of the sensing resistor R1 increases.

Consequently, it results that Vab=Vac+Vbe2. Since voltage Vab is fixed and because it is independent of the power supply voltage, being imposed by the IREF current generator, and because Vac increases, it follows that the base-emitter voltage Vbe2 of the second transistor T2 decreases. Consequently, the fact that the base-emitter voltage Vbe2 of the second transistor T2 decreases, requires that current I2 decreases because transistor T2 tends to switch off. If current I2 is reduced, it follows that the driver transistor T3 tends to switch off and then to decrease current I1. Similarly, if current I1 decreases, it follows that Vac is reduced. Consequently, the base-emitter voltage Vbe2 of the second transistor T2 increases, which implies that I2 increases. Therefore, the driver transistor T3 switches on more than that is currently decreasing its resistivity and, therefore, I1 increases.

Figure 3:
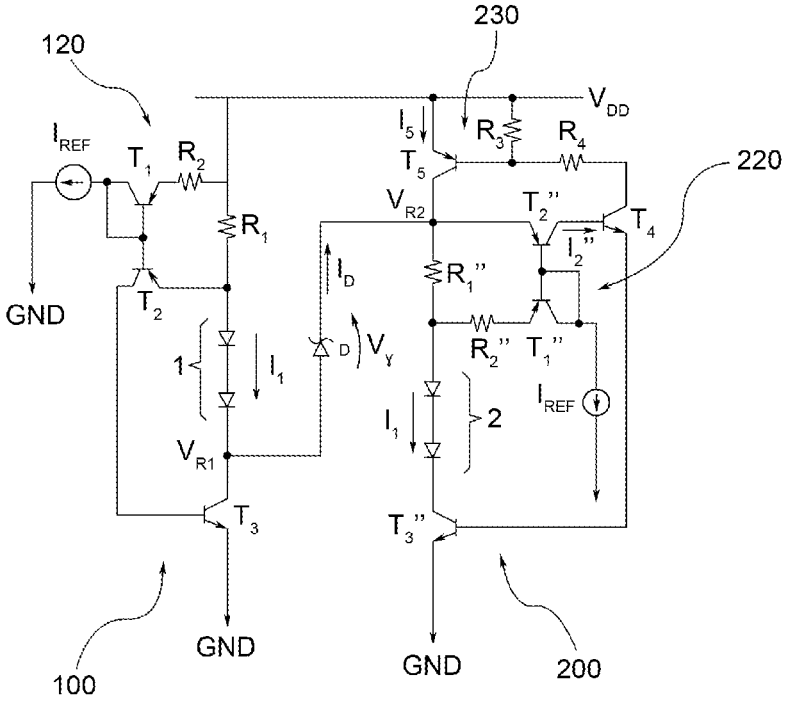
FIG. 3 is a circuit diagram of the driver circuit according to the invention, including two groups of light sources.

FIG. 3 shows the driver circuit of LEDs of the invention, wherein the first module 100 described above is connected to the second module 200. Specifically, the first 100 and the second module 200 are connected in parallel with each other between the power supply voltage VDD and ground GND. The first and the second module 100, 200 are connected via a serial connection circuit D, such as a schottky diode, to allow the serial connection of the first 1 and the 2 second group of LEDs.

With reference to FIG. 3, the second group of LEDs 2 is connected to the second regulation circuit 220 as shown above; however, the second group of LEDs 2 is also connected to the actuation circuit 230 of the regulation circuit 220. The second regulation circuit 220 is similar to the first regulation circuit 120 described above and thus includes a sensing resistor R1", to detect the current circulating on the branch of LEDs, a current mirror including a first transistor T1", a second transistor T2" and an emitter resistor R2", an IREF current generator and a driver transistor T3". The operation of the second regulation circuit 220 is similar to the first regulation circuit 120 and will not be further described.

The actuation circuit 230 of the regulation circuit 120 includes a first and a second transistor T4 and T5, and polarisation resistors R3 and R4. The first transistor T4 has the respective base connected to the collector of the second transistor T2" of the current mirror and the respective emitter connected to the base of the driver transistor T3". The second transistor T5 of the actuation circuit has the emitter-collector junction connected between the power supply terminal VDD and the sensing resistance R1" and the base connected, via a first polarisation resistor R4, to the collector of the first transistor T4 of the actuation circuit 230. The second polarisation resistor R3 is connected between the power supply terminal VDD and the base of the second transistor T5 of the actuation circuit 230.

The polarisation resistors R3 and R4 of the actuation circuit of the regulation circuit are sized so that the driver transistor T3" is saturated up to the passage from the parallel driving configuration to the serial driving configuration, as will be clear from the following description. If the driver transistor T3" is saturated, when the power supply voltage VDD increases, the current absorbed by the second group of LEDs 2 would increase exponentially. Consequently, the second group of LEDs 2 needs to be regulated via the actuation circuit 230 of the regulation circuit 220. The actuation circuit 230 acts through the first transistor T4. Specifically, the actuating circuit 230 provides the current necessary to the first transistor T4 in order to regulate the second group of LEDs 2 via the second transistor T5 of the actuating circuit 230, since the driver transistor T3" is saturated. Therefore, the task of dampening the current absorbed by the LEDs is transferred to the second transistor T5 of the actuating circuit 230, which operates in a linear zone. Consequently, the regulation of the second group of LEDs 2 is of the so-called "high side" type, instead of "low side" as in the case of the first module 100 described above, since the current absorbed by the second group of LEDs 2 upstream is dampened through transistor T5. This is imposed by the sizing of the polarisation resistors R3 and R4, because when the second transistor T5 of the actuation circuit is in the linear zone, the base current of the transistor T5, Ib5, is negligible.

The driver transistor T3" is powered through the current circulating on the polarisation resistor R3. Such a resistor R3 has a voltage set at its terminals, which is the base-emitter voltage of the second transistor T5, Vbe5. Therefore, the polarisation resistor R3 needs to be sized so as to ensure that the driver transistor T3" is saturated. This is achieved through the datasheet of the transistor, which specifies which the minimum current gain of the transistor is, so as to obtain the desired saturation of the transistor.

What described so far refers to the operation of the driver circuit of the LEDs of the invention in a first state thereof, in which the first and the second group of LEDs 1, 2 are arranged according to a first arrangement of the LEDs, as described above, which can be defined as parallel driving configuration.

Figure 4:
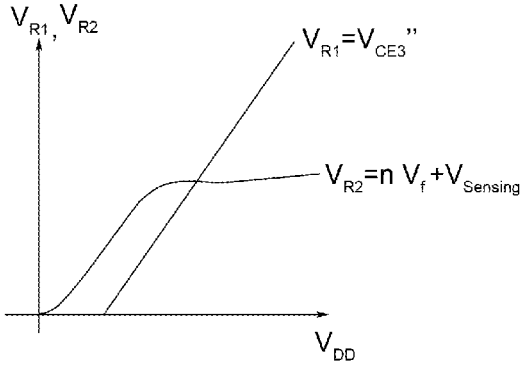
FIG. 4 is a graph showing the pattern of the voltage downstream of the first group of light sources and the voltage upstream of the second group of light sources of the driver circuit in FIG. 3, upon the variation of the power supply voltage.
Figure 5:
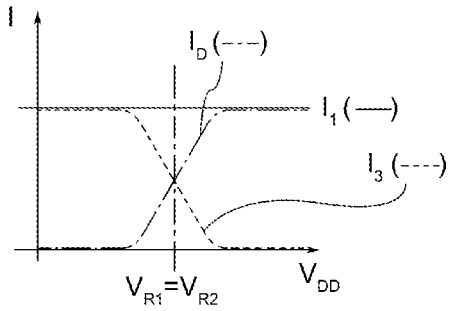
FIG. 5 is a graph showing the pattern of the current absorbed by the first group of light sources, the current circulating in the circuit serial connection and the collector-emitter current of the driver transistor, as a function of the supply voltage, during the passage from the parallel driving configuration to the serial driving configuration.

The points of the driver circuit of the LEDs of the invention indicated in FIG. 3, with VR1 and VR2, wherein VR1 is the voltage on the collector of the driver transistor T3 of the first group of LEDs 1, which initially operates in the saturation zone, and thus the voltage downstream of the first group of LEDs 1, while VR2 is the voltage on the collector of the second transistor T5 of the actuation circuit 230, and thus the voltage upstream of the second group of LEDs 2. The pattern of voltages VR1 and VR2 as a function of the power supply voltage VDD, shown in FIG. 4. Since the driver transistor T3 is in saturation, the downstream voltage VR1 will initially be at zero volts, then it will rise linearly with the supply voltage VDD. On the other hand, the upstream voltage VR2 is the sum of the voltage at the terminals of the sensing resistor R1" of the second module 200 plus the voltage at the terminals of the second group of LEDs 2, because the driver transistor T3" of the second module 200 is saturated. Therefore, since the transistor T3" is saturated, the voltage at the terminals of the second group of LEDs 2 increases and then remains constant.

Thus, the downstream voltage VR1 is equal to the collector-emitter voltage of the driver transistor T3, Vce3, of the first group of LEDs 1, while the upstream voltage VR2 is equal to the potential difference at the terminals of the number of serial LEDs in the second group of LEDS plus the sensing voltage of the current minor of the regulation circuit 220 of the second module 200 (the voltage at the terminals of the sensing resistor R1", which is constant and is imposed by the IREF current generator, through feedback). Therefore, the upstream voltage VR2 tends to be constant. Therefore, the downstream and upstream voltages VR1 and VR2 take on the pattern shown in FIG. 4.

It is therefore possible to identify a point of intersection between the two curves for the voltages VR1 and VR2. Specifically, when the downstream voltage VR1 increases, it intersects the upstream voltage VR2 (which remains constant) at a point where the collector voltage of the driver transistor T3 of the first module 100 rises above the voltage of the series forming the second group of LEDs 2. When the collector voltage of transistor T3 exceeds the upstream voltage VR2, there is the possibility to put the first and the second group of LEDs in series with each other because the downstream voltage VR1 is able to power the second group of LEDs 2.

While in the aforementioned dynamic matrix, the passage from the first to the second driving configuration of the LEDs occurred statically (when the power supply voltage VDD is equal to a predefined fixed voltage) in the driver circuit according to the invention, the passage between the two arrangements of the LEDs occurs when the downstream voltage VR1 is greater than the upstream voltage VR2, thus according to the junction voltage of the LEDs. If there are multiple groups of LEDs, the modules following the first one all take the circuit configuration described for the second module 200, wherein the nth group of LEDs is driven at first with an actuation circuit of the regulation circuit. In any case, all modules are connected to each other via a respective serial connection D. Therefore, if the downstream voltage (of a first group of LEDs) becomes greater than the upstream voltage VR1 (of a second group of LEDs) VR2, the serial connection D conducts. As a result, the path of the current crossing the first group of LEDs and the second group of LEDs changes, switching from a first configuration or arrangement of the LEDs ("parallel" configuration), in which VR1 is less than VR2, to a second configuration or arrangement of the LEDs ("serial" configuration), in which VR1 is greater than or equal to VR2.

In the first arrangement of the LEDs, the path of current I1 in the first group of LEDs and the path of current I1" in the second group of LEDs are separated, going from the power supply terminal VDD to ground, respectively. In other words, the branch of the first group of LEDs and the branch of the second group of LEDs are independent, because the serial connection circuit D prevents a current from going from the first to the second module. When voltage VR1 becomes greater than voltage VR2 (in the second arrangement of the LEDs), the current path crosses the first and the second group of LEDs in series from the power supply terminal VDD to ground.

According to one aspect of the invention, however, in the transition between the first and the second arrangement of the LEDs, there is an intermediate stage, which is a stable point of the LED driver circuit, wherein the serial connection circuit D allows a flow of electric current between the driver transistors T3, T3" of the first and second module, as if they were connected in series but at the same time, fractions of the driver currents I1 and I1" continue to flow separately on the first and second group of LEDs, respectively, as if the first and the second group of LEDs were connected in parallel. Thus, there is an overlap of these two effects during the intermediate stage. Therefore, at the downstream node VR1 of the first module, the driver currents I1 will be the sum of a "serial" current ID circulating through the serial connection circuit D and a "parallel" current circulating on the driver transistor T3 of the first module towards ground.

Specifically, the intermediate stage is the stage in which the serial connection circuit D is polarised so as to allow the flow of a current ID on the serial connection circuit D and of a current I3 on the driver transistor T3. The parallel current I3 does not coincide with the driver current I1 of the first group of LEDs, as in the case of the "parallel" configuration of the driver circuit.

By plotting the currents in the intermediate stage, the driver current I1 of the first group of LEDs is constant, because the first regulation circuit is active while the collector-emitter current I3 of the driver transistor T3 dampens progressively in favour of the serial current ID, which has a pattern specular to I3. Therefore, the driver transistor T3 progressively switches off until after the intermediate stage, a single driver current will cross the first group and the second group of LEDs (in series with each other), with the driver transistor of the first group T3 off and thus, with the collector-emitter current of the transistor equal to zero.

The second transistor T5 of the actuation circuit 230 behaves in the same way as the driver transistor T3, because in the branch of the second group of LEDs 2, before VR1=VR2, the driver current I1" of the second group of LEDs is equal to the emitter-collector current I5 that flows through the second transistor T5 of the actuation circuit 230. When the downstream voltage VR1 is approximately equal to upstream voltage VR2 it happens that, by applying Kirchhoff's law to node VR2, the driver current I1" of the second group of LEDs is given by the sum of the emitter-collector current IS that passes through transistor T5 with the serial current ID flowing through the serial connection circuit D. The driver current I1" of the second group of LEDs is constant because the regulation circuit 220 is active, the emitter-collector current I5 that passes through transistor T5 decreases progressively to zero, while the serial current ID increases in a specular manner. Therefore, also the second transistor T5 of the actuation circuit tends to switch off in the intermediate stage and, when VR1 becomes greater than VR2, the transistor T5 is switched off, as the driver transistor T3.

At the end of the intermediate stage and, thus, when the driver circuit has switched to the second arrangement of the LEDs ("serial" configuration; when VR1 is greater than VR2), the collector-emitter voltage of transistor T5, Vce5, for each voltage VR1 greater than VR2, is equal to the sensing voltage of the first module, i.e. to the voltage at the terminals of the sensing resistor R1 of the first module plus the junction voltage Vf of every single LED by the number n of serial LEDs in the first group of LEDs, plus the voltage drop Vy at the terminals of the serial connection circuit D:

$$Vce5=V\text{sensing}+n*Vf+V\gamma$$

Therefore, the collector-emitter voltage of transistor T5 is constant, being all terms of the addition constant. Therefore, transistor T5 of the actuation circuit can no longer be used for regulating, since a lower electric resistivity branch is connected in parallel between the collector and the emitter of the transistor T5 which is not able to be regulated as described above. In other words, transistor T5 of the actuation circuit is bypassed by the lowest electric resistivity branch including the sensing resistor R1 of the first module, the first group of LEDs 1, and the serial connection circuit D. As a result, the current that crosses the sensing resistor R1" of the second module 200 would tend to increase, thus decreasing current I2" flowing between the emitter and the collector of the second transistor T2" of the current mirror of the second module 200. Therefore, the first transistor T4 of the actuation circuit works so that the driver transistor T3" of the second module is forced to operate in linear zone, so as to allow a regulation of current I1" on the second group of LEDs, as imposed by the IREF current generator of the second regulation circuit 220.

Figure 6:
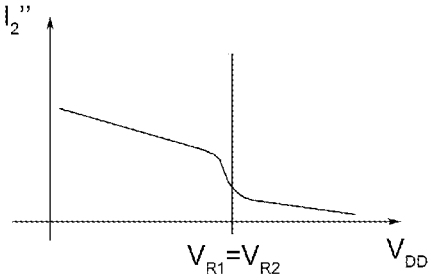
FIG. 6 is a graph showing the pattern of a current of the actuation circuit, as a function of the power supply voltage.

Also, as shown in FIG. 6, the collector current I2" of the second transistor T2" of the current mirror of the second module 200 having decreased, the first transistor T4 of the actuation circuit works so that the base current of the second transistor T5 of the actuation circuit further decreases, as long as the transistor T5 turns off. The driver current I1 circulating in the first group of LEDs and the driver current I1" circulating in the second group of LEDs in the first arrangement of the LEDs (when VR1<VR2), and the current circulating on the first and second group of LEDs in series with each other in the second arrangement of LEDs (when VR1>VR2) are the same. This is guaranteed by the IREF current generators of the first and second regulation circuit 120; 220, respectively, of the first and the second module.

Thus, if the downstream voltage VR1 is lower than the upstream voltage VR2, the driver transistors T3 of the first group of LEDs and the transistor of the actuation circuit T5 of the second group of LEDs are on and respectively regulate the first and the second group of LEDs; on the other hand, if VR1>VR2, the transistors T3 and T5 are off while the driver transistor T3" of the second group of LEDs is in linear zone and is able to regulate the first and the second group of LEDs arranged in series. Between these two configurations of the LEDs, there is the intermediate stage described above, in which an intermediate condition occurs between a parallel arrangement and a serial arrangement of the first and second group of LEDs, with all transistors T3, T3 and T5" able to regulate. In addition, as said above, the LED driver circuit may include further modules each include a regulation circuit, an actuation circuit of the regulation circuit and a group of LEDs, the further modules being connected in parallel to the previous modules between the power supply terminal VDD and ground, and wherein the serial connection circuit D connects each of the further modules at least to the adjacent module. In such circumstances, the same considerations above apply.

Figure 7:
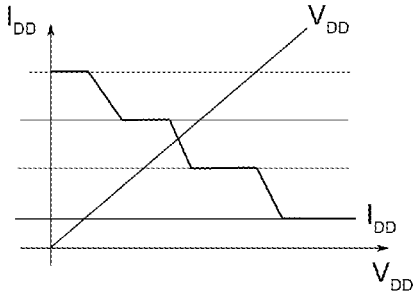
FIG. 7 is a graph showing the pattern of the total current absorbed by four groups of light sources when said groups are progressively connected in series with one another, as a function of the power supply voltage.

With reference now to FIG. 7, in an embodiment of the LED driver circuit provided, for example, with four modules, current IDD absorbed by the first, second, third, and fourth group of LEDs will be reduced by three times going from an initial driver configuration, in which all groups of LEDs are connected in parallel, to a second driver configuration, in which only the first two groups of LEDs are connected in series, to a third driver configuration, in which the first three groups of LEDs are connected in series, and finally to a fourth driver configuration of the LEDs, in which all four groups of LEDs are connected in series. The progressive reductions of the overall current ID are by the same extent since the current circulating on any branch of LEDs remains the same as the arrangements of the LEDs vary.

With reference to FIG. 7, the pattern of the current absorbed by the LEDs during an intermediate stage between one arrangement of the LEDs and the other should be noted. It is shown that the power decreases gradually up to a constant value, typical of the next arrangement of the LEDs, since a share of the current is supplied in parallel to the groups of LEDs, and a further share of current is supplied in series to the groups of LEDs.

Advantageously, since there is a stable intermediate stage, the driver circuit of the LEDs switches between the first and the second arrangement of the LEDs so that the electric power absorption of the driver circuit varies gradually. Thus, the electric power absorption of the driver circuit of the LEDs during the transition from one arrangement of LEDs to another does not change abruptly with a typical step pattern.

Such an advantage of the driver circuit of the invention can be particularly appreciated, for example, when there are noises in the power supply line which affect the pattern of the power supply voltage of the LEDs.

Figure 8:
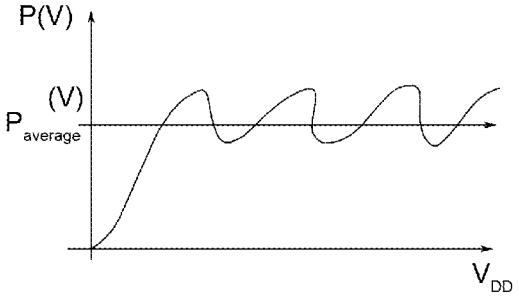
FIG. 8 is a graph showing the pattern of the electric power absorbed by the driver circuit during the variation of the arrangement of the groups of light sources, upon the variation of the power supply voltage.

If the power supply voltage varies linearly, it is possible to plot the pattern of the electric power absorbed by the driver circuit of the LEDs during the change of the arrangements of the LEDs, as shown in FIG. 8. The average power dissipation is kept constant when the power supply voltage VDD varies, so as to optimize the yield given by the output power divided by the power dissipated for the regulation. Advantageously, the switchover from one state to the next one in the supply of the groups of LEDs is not given by the switching of a switch and therefore it is not an abrupt or step-wise switchover, which is a source of flickering. The circuit according to the invention does not require any hysteresis to prevent a continuous switchover between the different configurations. Instead, the driver circuit according to the invention allows switching from one configuration to another by passing through a stable intermediate stage that guarantees the absence of spikes or flickering because of the permanent regulation (also in such an intermediate state) of the driver current of the groups of LEDs.

Figure 9:
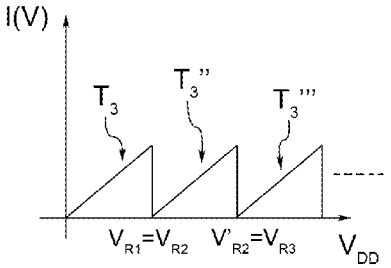
FIGS. 9 and 10 are graphs showing the pattern of the current absorbed by the driver transistors of the regulation circuit of groups of light sources progressively connected in series, and of the electric power absorbed by said transistors, respectively.
Figure 10:
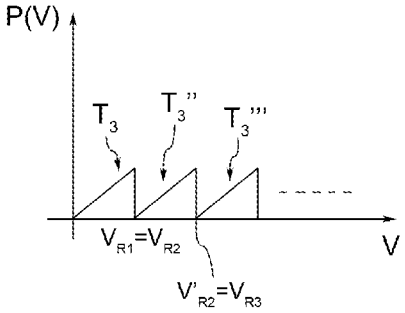

FIG. 9 shows the current pattern in the driver transistors T3, T3", T3"', . . . in the respective first regulation circuit 120 of the first module 100, second regulation circuit 220 of the second module 220, third regulation circuit 320 of the third module 300, etc. of a driver circuit of LEDs, as a function of the supply voltage VDD. FIG. 10 shows the pattern of the electric power absorbed by such transistors T3, T3", T3"'.

With reference to FIGS. 9 and 10, the first driver transistor T3 starts to linearly regulate first between transistors T3, T3", T3"', and it regulates until VR1 is equal to VR2. Subsequently, the first transistor T3 turns off. In turn, the second transistor T3" remains in saturation until VR1 is equal to VR2, then it begins to regulate linearly until V'R2 is equal to VR3, where V'R2 is the voltage downstream of the second group of LEDs and VR3 is the voltage upstream of the third group of LEDs. Subsequently, the second transistor T3" turns off. A similar behaviour occurs with the third driver transistor T3=".

Figure 11:
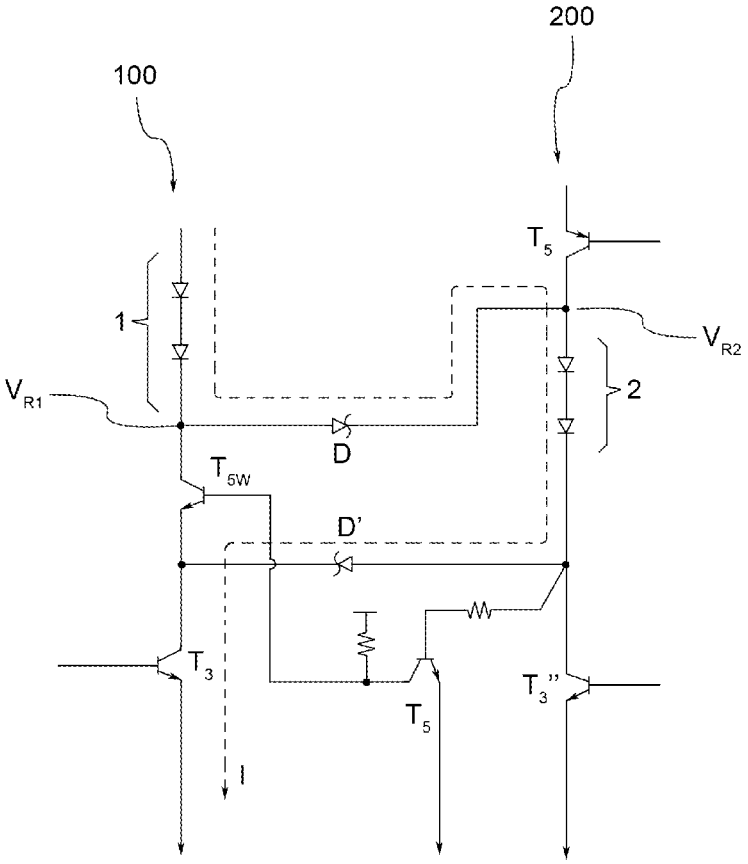
FIG. 11 is a circuit diagram of a driver circuit according to the invention, in an embodiment variant.

In an embodiment shown in FIG. 11, the driver circuit of LEDs is provided with a circuit switch configured to bypass the current paths no longer used. In particular, since the regulation current through the first driver transistor T3 has been replaced by the current crossing the relative serial connection circuit D, upon switching from the parallel configuration to the serial configuration, it is possible to replace the other driver transistors T3', T3"', . . . , which are power transistors, with a low power consumption signal transistor, and to still make the first driver transistor T3 perform the regulation. Of course, the further driver transistors T3", T3"', . . . , cannot be eliminated since a transistor in saturation is required which then goes in a linear zone long enough to start turn on the first driver transistor T3.

In the example in FIG. 11, the driver circuit is provided with a sensing transistor Ts connected to the collector of the second driver transistor T3" and configured to detect when the driver transistor T3" will go in linear zone. When this condition occurs, the first driver transistor T3 is off and then the branch that includes it can be switched off via a switch Tsw, controlled by the sensing transistor Ts. When such an interruption of the first branch occurs, the current can be made to flow from the second group of LEDs to the first driver transistor T3 through a return circuit branch D' (for example, a Schottky Diode), as indicated by the dashed line in FIG. 11. Similarly, the second transistor T5 of the actuation circuit can be replaced by a low-power signal transistor.

Figure 12:
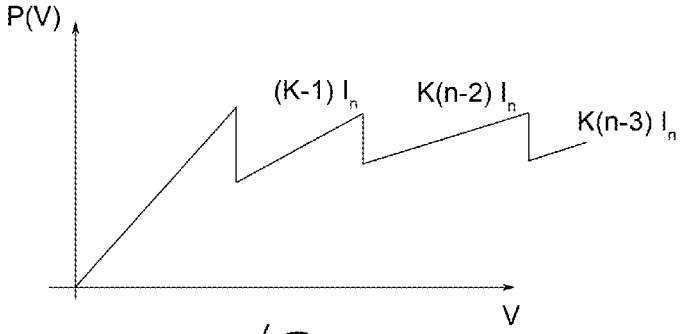
FIG. 12 is a graph showing the pattern of the electric power absorbed by the circuit in FIG. 11 as a function of the power supply voltage.

The diagram of the power absorbed by this driver circuit as a function of the supply voltage VDD is shown in FIG. 12, where the slope of the line varies with every variation of the LED arrangement, according to formula (k−n)*In, with n=1, 2, 3, . . . , k−1, because the number of branches is reduced.

Figure 13:
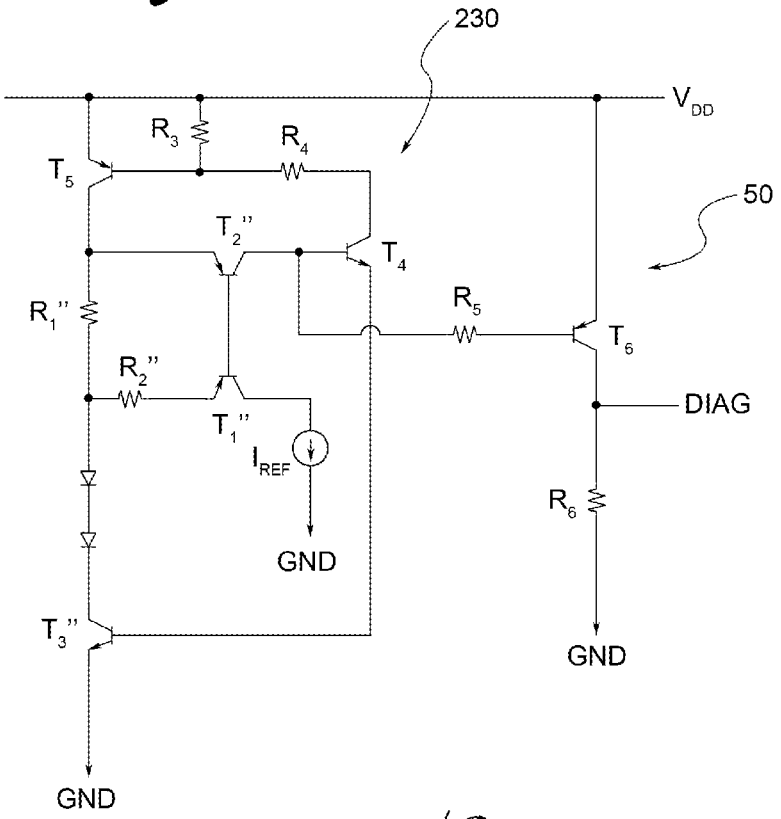
FIG. 13 is a circuit diagram of a second module of a driver circuit according to the invention in a further embodiment variant which contemplates the use of a diagnostic circuit.
Figure 14:
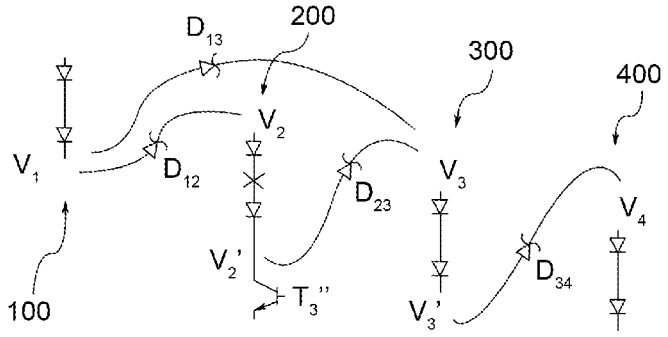
FIG. 14 schematically shows how the circuit in FIG. 13 manages a failure situation of a group of light sources in the parallel driving configuration.
Figure 15:
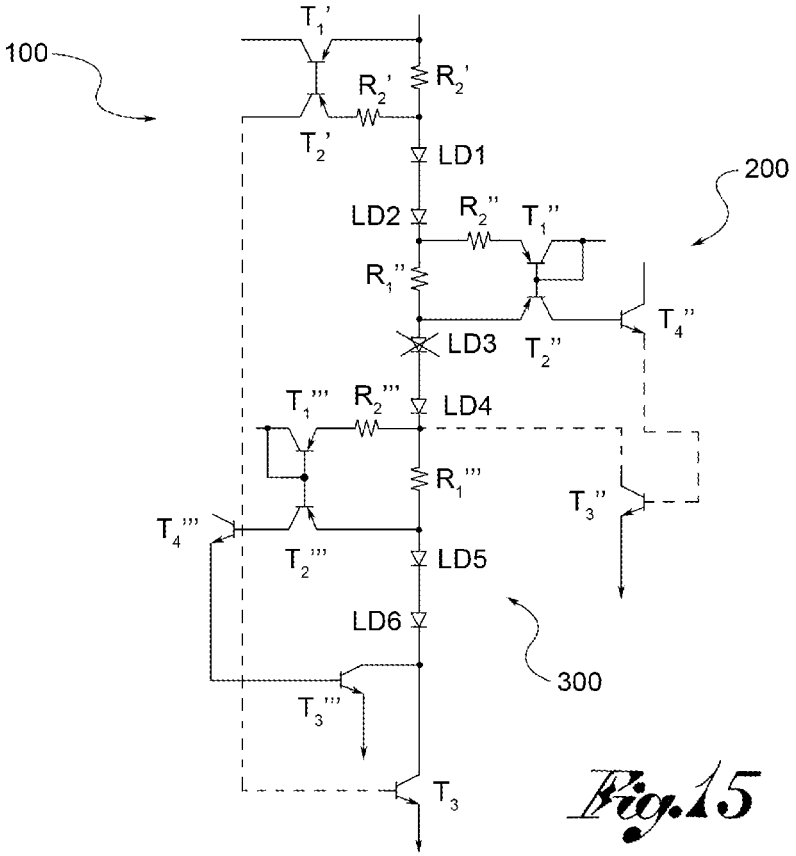
FIG. 15 shows a failure situation of a group of light sources in the serial driving configuration.

In another embodiment of the driver circuit, with a diagnostic system in case of failure of a light source is depicted in FIGS. 13, 14 and 15. As schematically shown in FIG. 14, the driver circuit includes a plurality of modules, for example, a first 100, a second 200, a third 300 and a fourth module 400, each including a respective group of LEDs, and a serial connection circuit Djk connecting the j-th group of LEDs with the k-th group of LEDs. With reference now to FIG. 13, where only the second module 200 of the driver circuit is shown, each module of the driver circuit of LEDs includes a diagnostic circuit 50 including a diagnostic transistor T6 having the collector-emitter junction connected between the power terminal VDD and ground GND through a first resistor R6, and the base connected to the collector of the second transistor T2" of the current mirror, through a second resistor R5.

Between the collector of the diagnostic transistor T6 and first electrical resistor R6, the diagnostic circuit provides a diagnostic signal DIAG (for example, an electric voltage) having a condition of normal operation or failure of the driver circuit of the LEDs. Such a diagnostic signal DIAG can be transmitted to, for example, an electronic control unit of the vehicle.

More specifically, in case of normal operation of the driver circuit of the LEDs, the circuit branch including the LEDs is crossed by an electric current. The second transistor T2" of the current mirror is thus polarised in linear zone and its collector-emitter voltage Vce2" is greater than zero, substantially on in the order of a few volts. In such a circumstance, the diagnostic transistor T6 is switched on in the saturation zone and, therefore, the diagnostic signal DIAG takes on a clearly high value to signal the normal operation of the driver circuit.

In the event of failure of an LED, identifiable with an open circuit, the circuit branch including the faulty LED is not crossed by an electric current. Consequently, transistor T2" is polarised in the saturation zone, since the potential difference between its base and its emitter is equal to the sum of the voltage at the terminals of the electric resistor R2" and of the base-emitter voltage Vbe1" of the first transistor T1" of the current mirror, where the latter electric voltages are imposed by the reference current IREF. For this reason, the collector-emitter voltage Vce2" of transistor T2" is substantially equal to zero volts. In such a circumstance, the diagnostic transistor T6 is turned off and, therefore, the diagnostic signal DIAG takes a low value to indicate the presence of a failure in the relative circuit branch. In the event of a failure, the driver circuit of the invention is able to handle both a first failure situation, in which the groups of light sources are connected in parallel, and a second failure situation, in which at least two groups of light sources are connected in series.

With reference to FIG. 14, which schematically shows the first failure situation, the failure occurs in a module of the driver circuit of the LEDs (for example, the second module) which is connected in parallel to one or more modules of the driver circuit of the LEDs. In this case, all the modules of the driver circuit of the LEDs are connected in parallel. The voltage VR1 downstream of the first group of LEDs of the first module can not exceed the voltage VR2 upstream of the second group of LEDs, upon variation of the power supply voltage VDD. This means that the condition in which the first and the second group of LEDs can be arranged in series with each another can not be verified and, therefore, the second module of the driver circuit, (the module including the faulty LED) must be excluded in any arrangement of LEDs, in which groups of LEDs, between the first, the second, the third and the fourth, are connected in series with each other.

In this case, the driver circuit of LEDs switches from an initial arrangement of LEDs, in which the modules are all connected in parallel, to a second arrangement of LEDs, in which the first and the third module are connected in series while the fourth module is connected in parallel to the series of the first and third module. Therefore, the serial connection circuit Djk mentioned above is driven (for example, by a circuit breaker device that operates on the basis of the diagnostic signal DIAG) to allow the driver circuit of the LEDs to switch to its second configuration.

More precisely, the serial connection circuit D13 is directly polarised to serially connect the branch including the first group of LEDs 1 with the branch including the third group of LEDs, while the serial connection circuit D12 and the serial connection circuit D23 are reverse polarised to exclude the second group of LEDs from the second arrangement of the LEDs, and from further arrangements of the LEDs (for example, one in which the first, third, and fourth module are arranged in series with each other).

It is clear to a person skilled in the art to implement the driver circuit of the invention including circuit arrangement suitable to connect the first group of LEDs with the group of LEDs between the third and the fourth, at the most suitable time. For example, in the event of failure of one LED of the second group of LEDs, the driver circuit of the LEDs can switch to a second arrangement of the LEDs when the first group of LEDs is connected to the fourth group of LEDs, instead of the third group of LEDs. The circuit arrangement of the driver circuit of the invention may select to switch to the LED arrangement when most suitable, among all those provided, even during normal operation of the driver circuit of the LEDs.

With reference now to FIG. 15, which shows the second failure situation (where some parts of the circuits related to the various modules are omitted), the failure occurs in a group of LEDs (for example, of the second module 200 of the driver circuit) when the latter is connected in series to at least one other module of the driver circuit of the LEDs (for example to the first 100 and third module 300).

More specifically, the sensing resistor R1 of the first module, the LEDs of the first group of LEDs, the sensing resistor R1" of the second module, the LEDs of the second group of LEDs, the sensing resistor R1'" of the third module, and the LEDs of the third group of LEDs are connected in series with one other, while the regulation of the LEDs belonging to the first, second, and third group, is carried out by the first regulation circuit 120 of the first module that operates by transistors T1, T2 of its current mirror and of the driver transistor T3.

If an LED in the second group is faulty, the electric current circulating on the sensing resistor R1 of the first regulation circuit substantially decreases to zero amps. However, the voltage at the terminals of the emitter resistor R2 of the current mirror remains constant, because it is imposed by the IREF current generator of the first regulation circuit and, therefore, since the voltage drop at the terminals of the resistor R2 is equal to the current flow on the sensing resistor R1 by the sensing resistor R1 value, plus the base-emitter voltage Vbe2 drop of transistor T2, the base-emitter voltage Vbe2 of transistor T2 increases. This has the effect of an increase of the collector current Ic2 of transistor T2 up to polarise transistor T3' in the saturation zone by transistor T4".

At this point, the first module is connected between the power supply voltage VDD and ground, the second form does not close to ground because of the fault, the third branch closes to ground through the respective driver transistor T'". In other words, all functioning modules are arranged in parallel, while the faulty module is excluded.

Figure 16:
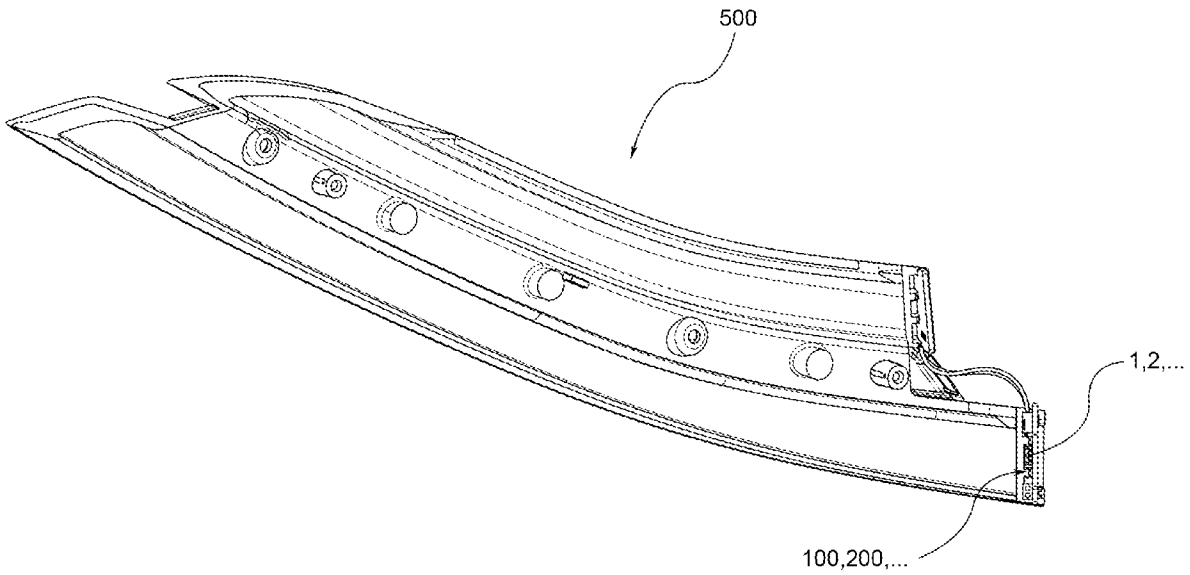
FIG. 16 shows an example of a vehicle incorporating the driver circuit according to the invention.

With reference to FIG. 16, the present invention also relates to a motor vehicle headlight 500 including a container body defining a compartment for seating LED light sources 1, 2, . . . driven by the driver circuit 100, 200, . . . described above.

A person skilled in the art may make several changes, adjustments, adaptations and replacements of elements with other functionally equivalent ones to the embodiments of the driver circuit according to the invention in order to meet incidental needs, without departing from the scope of the following claims. Each of the features described as belonging to a possible embodiment can be obtained independently of the other embodiments described.

What is claimed is:

1. Driver circuit of light sources, particularly of the LED type, comprising a first and at least a second group of light sources, each connected to a common power supply terminal, a first and at least a second regulation circuit, each suitable for regulating the current absorbed by a respective group of light sources, at least one actuation circuit operatively connected to a respective second regulation circuit, and serial connection circuit, suitable for connecting in series at least a first and a second group of light sources, when the voltage downstream of the first group of light sources is greater than or equal to the voltage upstream of the second group of light sources, wherein the regulation circuit of a first group of light sources, the actuation circuit and the regulation circuit of a second group of light sources are configured in such a way that:

when the voltage downstream of said first group of light sources is less than the voltage upstream of said second group of light sources, the first group of light sources is driven by the respective regulation circuit, while the actuation circuit inhibits the functioning of the second regulation circuit and drives the second group of light sources, on the basis of a reference electric magnitude of said second regulation circuit, in such a way that the first and the second group of light sources are driven in parallel;

when the voltage downstream of the first group of light sources is greater than or equal to the voltage upstream of the second group of light sources, the first and the second group of light sources connected in series with each other are driven by the second regulation circuit, the first regulation circuit and the actuation circuit being inhibited.

2. Driver circuit as set forth in claim 1, wherein, during the passage between the parallel driving configuration and serial driving configuration of two groups of light sources, a fraction of the flow of electric current absorbed by the first group of light sources powers the second group of light sources too, passing through the serial connection circuit, and at the same time said groups of light sources are powered independently by respective fractions of the driving current.

3. Driver circuit as set forth in claim 1, wherein each regulation circuit includes a driver transistor connected between the respective group of light sources and the ground and suitable for driving a driving current proportional to a reference electric magnitude.

4. Driver circuit as set forth in claim 3, wherein the serial connection has a first terminal connected between the first group of light sources and the driver transistor and a second terminal connected between the power supply terminal and the second group of light sources.

5. Driver circuit as set forth in claim 1, wherein each regulation circuit includes a sensing resistor suitable for detecting the current circulating in a respective group of light sources, a current mirror connected in parallel to said sensing resistor and to a respective driver transistor, and a generator of a reference electric magnitude operatively connected to said current mirror.

6. Driver circuit as set forth in claim 5, wherein the actuation circuit of the second regulation circuit includes a first actuation transistor having the base connected to the current mirror, the emitter connected to the base of the driver transistor and the collector connected to the base of a second actuation transistor, said second actuation transistor having the emitter-collector junction connected between the power supply terminal and the sensing resistor, the actuation circuit further including polarisation resistors suitable for polarising the driver transistor in the saturation zone and the second driver transistor in the linear zone during the parallel configuration.

7. Driver circuit as set forth in claim 5, wherein the second terminal of the serial connection is connected between the second actuation transistor and the sensing resistor of the second regulation circuit.

8. Driver circuit as set forth in claim 1, wherein each regulation circuit is configured so that the driving currents circulating in the first and in the second group of light sources in the parallel configuration and the driving currents circulating in the first and in the second group of light sources in the serial configuration are equal to each other.

9. Driver circuit as set forth in claim 1, wherein the serial connection includes a diode, such as a Schottky diode.

10. Driver circuit as set forth in claim 1, including a switchover circuit suitable for being activated at the moment of the passage from the parallel driving configuration to the serial driving configuration to exclude the driver transistor of the second regulation circuit and deviate the flow of current which crosses the second group of light sources onto the driver transistor of the first regulation circuit.

11. Driver circuit as set forth in claim 10, including a sensing transistor suitable for detecting when the transistor of the second regulation circuit is about to enter the linear zone, a switchover transistor placed between the first group of light sources and the respective driver transistor and controlled by said sensing transistor, and a return circuit branch which connects the second group of light sources to the driver transistor of the first regulation circuit.

12. Driver circuit as set forth in claim 1, including a plurality of light sources and a plurality of serial connections Djk suitable for connecting the j-th group of light sources to the k-th group of light sources, wherein said serial connections Djk are suitable for being activated by a circuit switch device controlled by a diagnostic circuit suitable for detecting a failure in the driver circuit, in such a way that, at the passage from the parallel driving configuration to the serial driving configuration, the serial connections connected to the group of light sources in which the failure occurred are deactivated to exclude said group of light sources from the serial driver configuration.

13. Driver method of light sources, in particular LEDs, where said light sources are divided into a first and at least a second group of light sources, each connected to a common power supply terminal, where each group of light sources is regulated in such a way as to absorb a driving current according to a predefined electric magnitude, comprising the step of switching from a parallel driving configuration, wherein said groups of light sources are powered independently by respective driving currents, to a serial driving configuration, wherein at least two groups of light sources are powered by the same driving current, wherein said switchover takes place when the voltage downstream of the first group of light sources is greater or equal to the voltage upstream of the second group of light sources.

14. Driver method as set forth in claim 13, wherein, during the passage between the parallel driving configuration and serial driving configuration of two groups of light sources, a fraction of the flow of electric current absorbed by the first group of light sources powers the second group of light sources too, passing through the serial connection circuit and at the same time said groups of light sources are powered independently by respective fractions of the driving current.

15. Method as set forth in claim 14 wherein, during the passage between the parallel driving configuration and serial driving configuration of two groups of light sources, the current absorbed by each group of light sources is a current regulated on the basis of a predefined electric magnitude.

16. Vehicle light, characterised in that it includes a driver circuit as set forth in claim 1.

* * * * *